US006513535B1

(12) United States Patent
Lane

(10) Patent No.: US 6,513,535 B1
(45) Date of Patent: Feb. 4, 2003

(54) HAIR ACCESSORY

(75) Inventor: Teresa Lane, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 0 days.

(21) Appl. No.: 09/782,630

(22) Filed: Feb. 13, 2001

(51) Int. Cl.[7] ..... A41G 3/00; A41G 5/00
(52) U.S. Cl. ..... 132/201; 132/56; 132/53
(58) Field of Search ..... 132/201, 53, 54, 132/55, 56

(56) References Cited

U.S. PATENT DOCUMENTS 57,328 A * 8/1866 Iverson ..... 132/53
541,125 A * 6/1895 Simonson ..... 132/53
3,307,562 A * 3/1967 Corbett et al. ..... 132/54
3,530,862 A * 9/1970 Hudson ..... 132/53
4,600,029 A * 7/1986 Ueberschaar ..... 132/53
5,180,325 A * 1/1993 Eddins et al. ..... 446/385
5,551,452 A * 9/1996 Barlow ..... 132/54
5,775,341 A * 7/1998 Abe et al. ..... 132/201
5,899,211 A * 5/1999 Brown ..... 132/201

* cited by examiner

*Primary Examiner*—John J. Wilson
*Assistant Examiner*—Robyn Kieu Doan
(74) *Attorney, Agent, or Firm*—Armstrong Teasdale LLP

(57) ABSTRACT

A method for fabricating a hair accessory includes attaching a plurality of hair strands including at least one of natural hair and synthetic hair to a support member and wrapping the hair support around at least one resilient member shaped substantially in a circle.

15 Claims, 2 Drawing Sheets

HAIR ACCESSORY

BACKGROUND OF THE INVENTION

This invention relates generally to hair accessories and, more particularly, to hair accessories that supplement the natural hair of a user.

Users supplement their natural hair to allow a wider variety of hair styles to be imparted to the user's hair. Additionally, when users are endowed with relatively little hair, the users can supplement their hair to create the impression of a fuller head of hair. At least one known form of a hair piece provides for these objectives by attaching a hair switch to a hair clip such that the hair piece hangs from the hair clip, see U.S. Pat. No. 5,501,239. However, the user may wish to wear a hair accessory to supplement the user's natural hair without a visible attachment device.

BRIEF SUMMARY OF THE INVENTION

In one aspect of the invention, a method for fabricating a hair accessory includes attaching a plurality of hair strands including at least one of natural hair and synthetic hair to a support member. The hair support is wrapped around at least one substantially circular resilient member.

In another aspect of the invention, a hair accessory includes an inner diameter including an inner surface, an outer diameter, and a plurality of outward arcing strands extending arcuately from the inner diameter to the outer diameter.

In an alternative embodiment, a hair accessory includes a strand retention member including a plurality of strand bundles attached to a support member and at least one resilient member. The strand retention member is spirally wrapped around the resilient member such that a plurality of strands arcuately extend from the strand retention member forming a plurality of outward arcing strands and a plurality of inward arcing stands, wherein the resilient member substantially forms a circle.

DETAILED DESCRIPTION OF THE INVENTION

Figure 1:
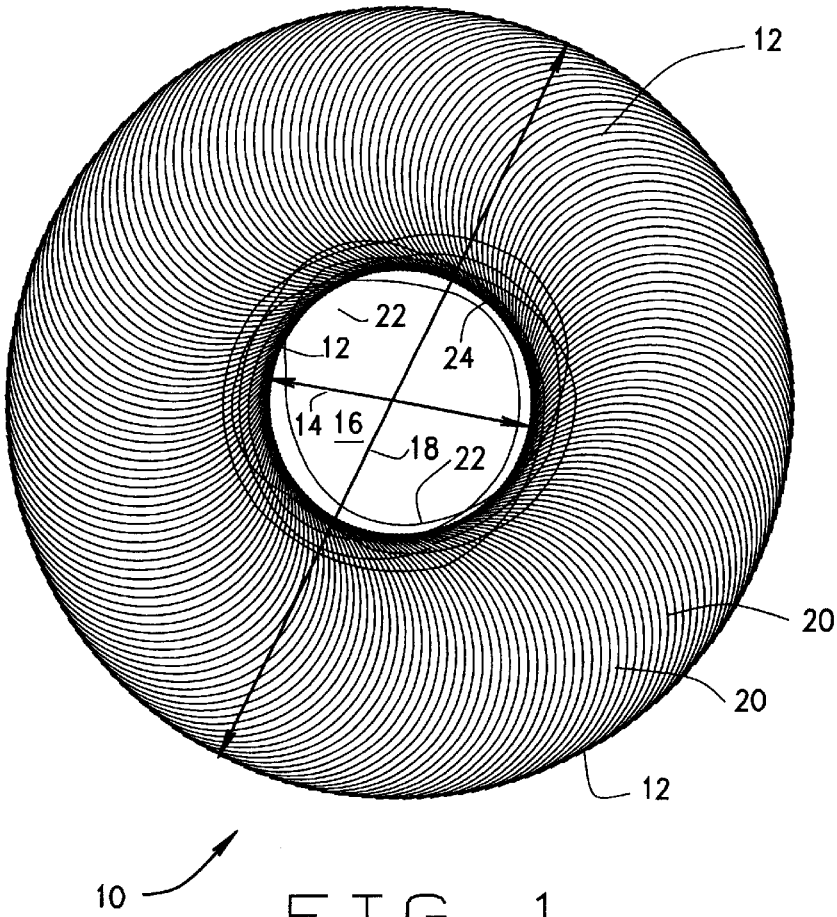
FIG. 1 is a plan view of a hair accessory in accordance with one embodiment of the invention.

FIG. 1 is a plan view of one embodiment of a hair accessory 10 including a plurality of arcuately extending hair strands 12 including synthetic hair. In an exemplary embodiment, the synthetic hair is fabricated from a polymer fiber such as modacrylic. In another embodiment, the synthetic hair is fabricated from a polymer fiber other than modacrylic, such as, for example, acrylic. In an alternative embodiment, hair strands 12 include natural hair. In a further alternative embodiment, hair strands 12 include at least one of synthetic hair and natural hair. Hair accessory 10 further includes an inner diameter 14 forming a bore 16, and an outer diameter 18. In one embodiment, inner diameter 14 is between about 6 centimeters (cm) and about 10.5 cm. In another embodiment, inner diameter 14 is between about 7 cm and about 9.5 cm. In another embodiment, inner diameter 14 is between about 8 cm and about 8.5 cm. In an exemplary embodiment, inner diameter 14 is about 8.25 cm. Strands 12 include a plurality of outward arcing strands 20 and a plurality of inward arcing strands 22. Arcuately extending strands 12 have varying lengths wherein each strand 12 is between about 7.5 cm and about 10.2 cm long and wherein strands 12 average about 9 cm in length. Each strand 12 is curved such that, although the length of each strand 12 is about 9 cm, the distance from one end of each strand 12 to the other end of each strand 12 is about 6 cm and, therefore, outer diameter 18 is about 20.5 cm. Accordingly, each strand includes an arc approximately equal to an arc of a circle having a diameter of approximately 8.25 cm, and inward arcing strands 22 substantially follow an inner surface 24 defined by inner diameter 14 such that inward arcing strands 22 extend substantially co-arcuate with inner surface 24 and remain within about 2 cm from inner surface 24.

In one embodiment, a user forms a ponytail with the user's natural hair and passes the ponytail through bore 16, and as is known with conventional ponytail holders, the user twists hair accessory 10 forming a figure eight wherein the ponytail is in a first loop of the figure eight and the user passes the ponytail through the second loop formed by the figure eight. Accordingly, bore 16 is effectively reduced in size to provide a proper fit to an average sized ponytail facilitating a retention of hair accessory 10 in the user's natural hair. The user can utilize the addition of hair strands 12 to the user's natural hair to provide various hair styles, some of which may not be attainable, or desirable in appearance, without hair accessory 10.

Figure 2:
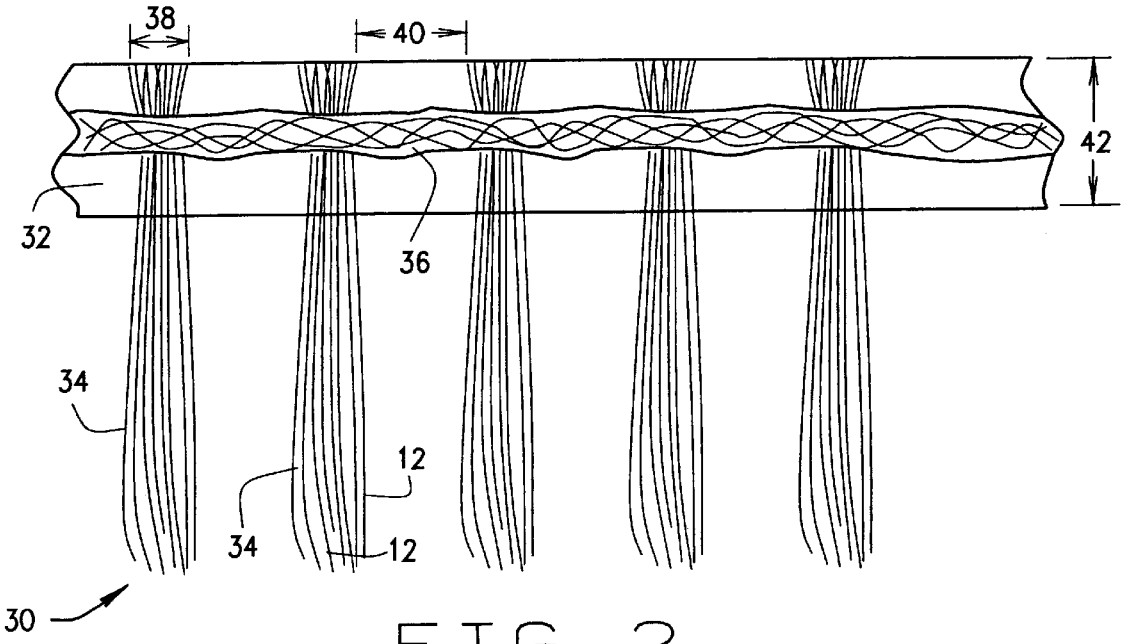
FIG. 2 is a side view of a portion of a strand retention member utilized in fabrication of the hair accessory shown in FIG. 1.

FIG. 2 is a side view of a portion of a strand retention member 30 utilized in hair accessory 10. Strand retention member 30 includes a support member 32 upon which is mounted a plurality of strand bundles 34. Each strand bundle 34 is attached to strand retention member 30 by a plurality of threads 36. Each bundle 34 includes between about fifteen and about forty strands 12. Each bundle 34 has a width 38 of about 1.6 millimeter (mm) and is separated from other bundles 34 by a spacing 40 of about 0.8 mm. Support member 32 includes a width 42 of about 9.5 mm. Strands 12 extend arcuately in a direction normal to the plane of width 42, e.g., into FIG. 2 or out from FIG. 2.

Figure 3:
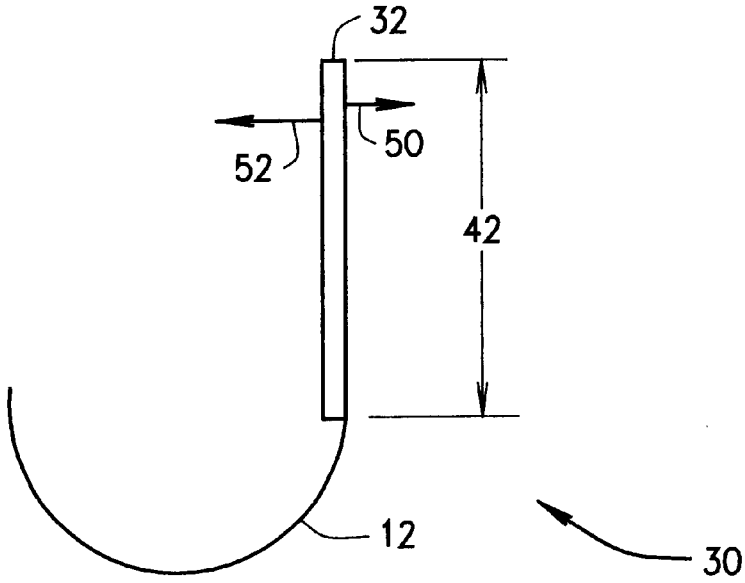
FIG. 3 is an end view of the strand retention member shown in FIG. 2.

FIG. 3 is an end view of strand retention member 30 illustrating a first direction 50 normal to width 42 and a second direction 52 normal to width 42. Strands 12 arcuately extend in second direction 52.

Figure 4:
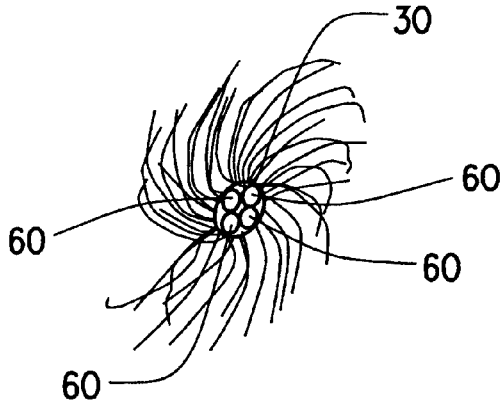
FIG. 4 is a cross-sectional view of the strand retention member shown in FIG. 2 wrapped around a plurality of resilient members.

FIG. 4 is a cross-sectional view of strand retention member 30 spirally wrapped around a plurality of resilient members 60. In an exemplary embodiment, strand retention member 30 is spirally wrapped around four resilient members 60.

During fabrication of hair accessory 10, strand retention member 30 is spirally wrapped around at least one resilient member substantially forming a circle defined by inner diameter 14 (shown in FIG. 1). In one embodiment, strand retention member 30 is wrapped around at least one resilient member forming a continuous loop and can be in a shape other than substantially forming a circle, such as, for example, an oval. In an alternative embodiment, strand retention member 30 is spirally wrapped around at least one resilient member having two ends which are joined with an attachment device. In an exemplary embodiment, the ends are sewn together. In another embodiment, the attachment device is a snap. In an alternative embodiment, the attachment device is a hook and loop pressure fastener (velcro). In a further embodiment, the attachment device is a button fastener. Because strands 12 extend arcuately normal to width 42, spirally wrapping strand retention member 30 causes more than 50% of strands 12 to extend outward forming outward arcing strands 20 and less than 50% of strands 12 extend inward forming inward arcing strands 22. In an exemplary embodiment, a helix angle is chosen in coordination with inner diameter 14 such that at least 80% of strands 12 are outward arcing strands 20. In one embodiment, strand retention member 30 is spirally wrapped around a plurality of resilient members and thus hair accessory 10 is still useable if one resilient member should break. In another embodiment, strand retention member 30 is spirally wrapped around four resilient members and thus hair accessory 10 is useable if one or more resilient members break. While more than four resilient members may provide a longer life and withstand the breakage of many resilient members, utilizing four resilient members provides a cost-effective and long lasting hair accessory 10.

While the invention has been described in terms of various specific embodiments, those skilled in the art will recognize that the invention can be practiced with modification within the spirit and scope of the claims.

What is claimed is:

1. A method for fabricating a hair accessory, said method comprising the steps of:

attaching a plurality of hair strands including at least one of natural hair and synthetic hair to a support member; and spirally wrapping the support member around at least one resilient member shaped substantially in a circle.

2. A method according to claim 1 wherein said step of attaching a plurality of hair strands further comprises the step of attaching a plurality of bundles of hair strands to the support member.

3. A method according to claim 1 wherein said step of wrapping the hair support further comprises the step of wrapping the hair support around at least one substantially circular resilient member having a diameter between about 8 cm and about 8.5 cm.

4. A method according to claim 1 wherein said step of attaching a plurality of hair strands further comprises the step of attaching a plurality of arcuate hair strands having an average length of about 9 cm wherein the average distance from one end of each strand to another end of each strand is about 6 cm.

5. A method according to claim 1 wherein said step of wrapping the hair support further comprises the step of wrapping the hair support around at least one substantially circular resilient member having a diameter between about 8 cm and about 8.5 cm, said step of attaching a plurality of hair strands further comprises the step of attaching a plurality of arcuate hair strands having an average length of about 9 cm wherein the average distance from one end of each strand to another end of each strand is about 6 cm.

6. A hair accessory comprising:

a strand retention member comprising a plurality of strand bundles attached to a support member; and at least one resilient member, said strand retention member spirally wrapped around said resilient member such that a plurality of hair strands arcuately extend from said strand retention member forming a plurality of outward arcing strands and a plurality of inward arcing strands, said resilient member comprising a continuous loop.

7. A hair accessory according to claim 6 wherein said plurality of strands arcuately extend from said strand retention such that at least 50% of said strands form a plurality of outward arcing strands.

8. A hair accessory according to claim 6 wherein said plurality of strands arcuately extend from said strand retention such that at least 80% of said strands form a plurality of outward arcing strands.

9. A hair accessory according to claim 6 wherein said resilient member substantially forming a circle having a diameter between about 7 cm and 9.5 cm.

10. A hair accessory according to claim 6 wherein said resilient member substantially forming a circle having a diameter between about 8 cm and 8.5 cm.

11. A hair accessory according to claim 6 wherein said resilient member substantially forming a circle having a diameter of about 8.25 cm.

12. A hair accessory according to claim 6 wherein said resilient member comprises four resilient members.

13. A method for fabricating a hair accessory, said method comprising:

attaching a plurality of hair strands including at least one of natural hair and synthetic hair to a support member; and wrapping the support member after the plurality of hair strands are attached to the support member around at least one resilient member shaped substantially in a circle.

14. A method according to claim 13 wherein said attaching a plurality of hair strands further comprises attaching a plurality of bundles of hair strands to the support member.

15. A method according to claim 13 wherein said attaching a plurality of hair strands further comprises attaching a plurality of arcuate hair strands having an average length of about 9 cm wherein the average distance from one end of each strand to another end of each strand is about 6 cm, said wrapping the hair support further comprises wrapping the hair support around at least one substantially circular resilient member having a diameter between about 8 cm and about 8.5 cm.

* * * * *